US005919349A

United States Patent [19]

Huber et al.

[11] Patent Number: 5,919,349

[45] Date of Patent: Jul. 6, 1999

[54] ELECTROCHEMICAL REDUCTION OF ORGANIC COMPOUNDS

[75] Inventors: Günther Huber, Ludwigshafen-Ruchheim; Andreas Weiper-Idelmann, Waldsee; Andreas Kramer, Wildeshausen; Rolf Golombek, Neustadt; Markus Frede, Eppelheim; Luise Spiske, Seeheim-Jugenheim; Karl-Heinz Schehlmann, Schifferstadt; Volker Steuer, Lambsheim, all of Germany

[73] Assignee: BASF Aktiengesellschaft, Ludwigshafen, Germany

[21] Appl. No.: 08/859,034

[22] Filed: May 20, 1997

[30] Foreign Application Priority Data

May 23, 1996 [DE] Germany ..... 196 20 861

[51] Int. Cl.[6] ..... C25B 3/00; C25B 11/04; C25B 11/12

[52] U.S. Cl. ..... 205/413; 205/423; 205/431; 205/440; 205/444; 204/292; 204/293; 204/294

[58] Field of Search ..... 205/413, 423, 205/431, 440, 444; 204/292, 293, 294

[56] References Cited

U.S. PATENT DOCUMENTS

| | | | |
|---|---|---|---|
| 4,217,185 | 8/1980 | Kyriacou et al. | 204/73 R |
| 4,584,069 | 4/1986 | Lessard et al. | 204/74 |
| 5,164,091 | 11/1992 | Huber et al. | 210/638 |
| 5,620,584 | 4/1997 | Reetz et al. | 205/334 |

FOREIGN PATENT DOCUMENTS

| | | |
|---|---|---|
| 0 133 468 | 2/1985 | European Pat. Off. . |
| 0 133 468 | 3/1985 | European Pat. Off. . |
| 0 435 434 | 7/1991 | European Pat. Off. . |
| 0 479 052 | 4/1992 | European Pat. Off. . |
| 0 808 920 | 11/1997 | European Pat. Off. . |
| 44 08 512 | 9/1995 | Germany . |

OTHER PUBLICATIONS

V. Anantharaman et al., "The Electrocatalytic Hydrogenation of Glucose II. Raney Nickel Powder Flow–Through Reactor Model," J. Electrochem. Soc., vol. 141, No. 10, Oct. 1994, pp. 2742–2752.

K. Park, et al., "Flow reactor Studies of the Paired Electro–Oxidation and Electroreduction of Glucose," vol. 132, No. 8, pp. 1850–1855. No date available.

K. Park, et al., "Current Efficiencies and Regeneration of Poisoned Raney Nickel in the Electrohydrogenation of Glucose to Sorbitol," Journal of Applied electrochemistry 16 (1986), pp. 941–946. No month available.

K. Otsuka, et al., "Dimethyl Carbonate Synthesis by Electrolytic Carbonylation of Methanol in the Gas Phase," Electrochemica Acta, vol. 39, No. 14, 1994, pp. 2109–2115. No month available.

85–045250/06 Abstract = EP 0 133 468, no date available.

98–001803/01 Abstract = EP 0 808 920, no date available.

Coche et al., "Electrocatalytic Hydrogenation Using Precious Metal Microparticles in Redox–Active POlymer Films", J. Org. Chem., vol. 55, No. 23, pp. 5905–5910. Abstract Only, no month available 1990.

*Primary Examiner*—Kathryn Gorgos
*Assistant Examiner*—Edna Wong
*Attorney, Agent, or Firm*—Oblon, Spivak, McClelland, Maier & Neustadt, P.C.

[57] ABSTRACT

A process for the electrochemical reduction of an organic compound by bringing the organic compound into contact with a cathode, wherein the cathode comprises a support made of an electrically conductive material and an electrically conductive, cathodically polarized layer formed thereon in situ by alluviation.

8 Claims, No Drawings

ELECTROCHEMICAL REDUCTION OF ORGANIC COMPOUNDS

BACKGROUND OF THE INVENTION

1. Field of the Invention

The present invention relates to a process for the electrochemical reduction of organic compounds.

2. Description of the Background

The electrochemical reduction of organic compounds has hitherto been used on an industrial scale only in exceptional cases, eg. for the cathodic dimerization of acrylonitrile. Because current densities were inadequate in economic terms, which meant that space-time yields (STY) were too small, current yields were too low, hydrogen was being formed, selectivities with a view to a number of possible reduction steps were too low, the special catalytically active cathodes were not sufficiently available on a technical scale and/or the on-stream times of the catalytically active cathodes were too short, it has hitherto not been possible for electrochemical reduction on cathodes to be utilized industrially.

A computer-assisted simulation for electrochemical hydrogenation of glucose is described by V. Anantharaman et al. in J. Electrochem. Soc., 141, (1994) pp. 2742–2752, the results of this simulation being compared with experimental data by K. Park et al. which were published in J. Electrochem. Soc., 132, (1985) pp. 1850 et seq. and J. Appl. Electrochem., 16, (1986) pp. 941 et seq.. As can be gathered from this publication this reaction, which is carried out using a continuous reactor comprising a sintered-glass disk and powdered Raney nickel embedded therein as the electrically conductive substance as the cathode, likewise generates hydrogen.

It is also known, from publications on preparative organic electrochemistry (eg. Electrochimica Acta, 39, (1994) pp. 2109–2115) that anodes and cathodes used in preparative electrochemistry must have special electrochemical characteristics. Such electrodes are often fabricated by metallic or carbonaceous support electrodes being coated by means of suitably adapted coating methods such as plasma spraying, impregnation and stoving, hot pressing etc. (see, instead of many, EP-B 0 435 434).

A drawback of these established fabrication methods is that the electrodes, after inactivation of the catalytically active layer, often have to be removed from the electrolytic apparatus and subjected to external regeneration, so that short catalyst on-stream times preclude economic utilization of the electrochemical synthesis system. A further drawback consists in the laborious preparation of the catalytically active layer as such and the difficulties in achieving adequate bonding to the support electrode. The development effort for a classic electrode coating process can in many cases be justified in economic terms only with major industrial processes such as chlorine-alkali electrolysis or the cathodic dimerization of acrylonitrile. The use of commercially heterogeneous catalysts is often not a practical option, because thermal transformation in the case of thermal coating processes or masking of the active regions in the case of cold-bonding processes cannot be precluded.

A catalytically active electrode, which is constructed as a perfused filter layer comprising a suspension of finely disperse catalyst material on a porous base body, is used according to EP-B 0 479 052 in a process for separating metal ions from process waters and effluents.

SUMMARY OF THE INVENTION

In view of the prior art set forth hereinabove it is an object of the invention to provide a process for reducing organic compounds, which on the one hand gives high space-time yields, permits high selectivity in the case of multiply reducible compounds, which avoids the formation of hydrogen during the reduction and can be used on an industrial scale.

This object is achieved according to the invention by means of a process for the electrochemical reduction of an organic compound by bringing the organic compound into contact with a cathode, wherein the cathode comprises a support made of a conductive material and an electrically conductive, cathodically polarized layer formed thereon in situ by alluviation.

DETAILED DESCRIPTION OF THE INVENTION

Within the scope of the novel process in the operational state this involves the catalytically active electrode being stabilized by the pressure drop at the electrically conductive, cathodically polarized layer formed by alluviation. For regeneration purposes, the catalytically active electrode can be resuspended by inversion of the flow and can be discharged, for example, by filtration or removal by suction. The reduction of organic compounds is therefore carried out on a system which is suitable for forming and dismantling a catalytically active electrode within the process, merely requiring interventions already established within the operational practice of a chemical plant, such as switching of pumps and final controlling elements.

Used as the support for the electrically conductive, cathodically polarized layer are electrically conductive materials, examples to be mentioned being materials such as alloy steel, steel, nickel, nickel alloys, tantalum, platinized tantalum, titanium, platinized titanium, graphite, electrode carbon and similar materials and mixtures thereof.

The supports are preferably present as a permeably porous material, ie. the support has pores. These may be woven, in the form of commercially available filter fabrics, from metal wires or carbon fibers. Common examples include filter fabrics of plain weave, twill weave, warp twill weave, chain weave and satin weave type. It is also possible to employ perforated metal foils, metal felts, graphite felts, edge filters, screens or porous sintered bodies as large-area supports in the form of plates or candles. The pore size of the support is generally from 5 to 300 $\mu$m, preferably from 50 to 200 $\mu$m. The support should always be designed so as to provide the largest possible open area, so that the pressure drops to be overcome in carrying out the process according to the invention are only minor. Normally, the supports which are readily usable within the scope of the present process have an open area of preferably at least about 30%, more preferably at least about 20% and especially about 50%, the open area being at most about 70%.

The electrically conductive material used for the electrically conductive, cathodically polarized layer may be any electrically conductive materials, as long as these can be formed into a layer by alluviation against the above-defined support.

The cathodically polarized layer preferably contains a metal, a conductive metal oxide or a carbonaceous material such as, eg. carbon, especially activated carbon, carbon blacks or graphites or a mixture of two or more thereof.

The metals employed preferably comprise all the classic hydrogenation metals, in particular the metals of the Ist, IInd and VIIIth subgroup of the Periodic Table of the Elements, especially Co, Ni, Fe, Ru, Rh, Re, Pd, Pt, Os, Ir, Ag, Cu, Zn, Pb and Cd, of which Ni, Co, Ag and Fe are preferably used as Raney Ni, Raney Co, Raney Ag and Raney Fe, any of which may be doped with impurity metals such as Mo, Cr, Au, Mn, Hg, Sn or other elements of the Periodic Table of the Elements, especially S, Se, Te, Ge, Ga, P, Pb, As, Bi and Sb.

The metals used according to the invention are preferably present in finely disperse and/or activated form.

It is also possible to employ conductive metal oxides such as eg. magnetite.

Furthermore, the cathodically polarized layer may also be formed solely by alluviation of the above-defined carbonaceous material.

In addition, the cathode can be built up in situ by the abovementioned metals and conductive oxides, each on carbonaceous materials, in particular activated carbon, being alluviated on the support.

The present invention therefore also relates to a process of the type herein referred to, the cathodically polarized layer containing a metal or a conductive metal oxide or a mixture of two or more thereof, applied to activated carbon in each case.

Particularly worth mentioning among these are layers containing Pd/C, Pt/C, Ag/C, Ru/C, Re/C, Rh/C, Ir/C, Os/C and Cu/C, these again optionally being doped with impurity metals or other elements of the Periodic Table of the Elements, preferably S, Se, Te, Ge, Ga, P, Pb, As, Bi and Sb.

Furthermore, the abovementioned metals alluviated against the support may be in the form of nanoclusters, whose preparation is described eg. in DE-A-44 08 512 on surfaces such as eg. metals and carbonaceous materials.

Additionally, the cathodically polarized layer may contain an electrically conductive adjuvant which improves adhesion of the abovementioned metals, metal oxides or nanoclusters on the support or enlarges the surface area of the cathode, electrically conductive oxides such as magnetite and carbon, in particular activated carbon, carbon blacks, carbon fiber and graphites being worth mentioning.

In a further embodiment of the present process, a cathode is used which is obtained by the electrically conductive adjuvant first being alluviated onto the support and this adjuvant then being doped in situ, on the coated electrode, with these metals by means of reduction of salts of metals of the Ist, IInd and/or VIIIth subgroup. The preferentially used salts of the abovementioned metals are metal halides, metal phosphates, metal sulfates, metal chlorides, metal carbonates, metal nitrates and the metal salts of organic acids, preferably formates, acetates, propionates and benzoates, especially preferably acetates.

In so doing, the cathode used according to the invention is built up in situ by the abovementioned metals or metal oxides being alluviated against the support either directly or after application of the electrically conductive adjuvant.

The mean particle size of the particles forming the above-defined layer and the thickness of the layer are always chosen so as to ensure an optimum ratio of filter pressure drop and hydraulic throughput and enable optimum mass transfer. The mean particle size is generally from about 1 to about 400 $\mu$m, preferably from about 30 to about 150 $\mu$m, and the thickness of the layer is generally from about 0.05 mm to about 20 mm, preferably from about 0.1 to about 5 mm.

Note should be taken of the fact, in this context, that in the process according to the invention the pore size of the support generally exceeds the mean diameter of the particles forming the layer, so that two or more particles form bridges across the interstices while the layer is being formed on the support, this having the advantage that the formation of the layer on the support does not result in any significant obstruction of the flow for the solution containing the organic compound to be reduced. Preferably the pore size of the support is about twice to four times as large as the mean particle size of the particles forming the layer. Of course it is also possible, within the scope of the present invention, to employ supports having pore sizes which are smaller than the mean particle size of the particles forming the layer, although in that case a very close watch should be kept on the extent to which the flow is obstructed by the layer being formed.

As already mentioned above, the cathode employed according to the invention is formed in situ by alluviation, against the electrically conductive support, of the constituents forming the layer, the solution which contains the particles forming the layer perfusing the support until the entire proportion of solids of said solution has been alluviated or retained.

After the reduction is complete or when the catalytically active layer is spent, it can be separated from the support, by a simple switch of the flow direction, and can be disposed of or regenerated, independently of the reduction. After the spent layer has been completely removed from the system, it is then possible once more to recoat the support with the particles forming the layer and, after said particles have been completely alluviated, to continue the reduction of the organic compound.

The current densities within the process according to the invention are generally from about 100 to about 10,000 $A/m^2$, preferably from about 1000 to about 4000 $A/m^2$.

The throughput of the solution containing the organic compounds to be reduced is generally from about 1 to about 4000 $m^3/(m^2 \times h)$, preferably from about 50 to about 1000 $m^3/(m^2 \times h)$. For a system pressure of, in general, from about $1 \times 10^4$ Pa (absolute) to about $4 \times 10^6$ Pa, preferably from about $4 \times 10^4$ Pa to about $1 \times 10^6$ Pa, the pressure drop in the layer at the throughputs employed according to the invention is from about $1 \times 10^4$ Pa to about $2 \times 10^5$ Pa, preferably from about $2.5 \times 10^4$ Pa to about $7.5 \times 10^4$ Pa.

The process according to the invention is generally carried out at from about −10° C. up to the boiling point of the solvent or solvent mixture, temperatures between about 20° C. and about 50° C., especially close to room temperature, being preferred, however.

The process according to the invention can be carried out, depending on the compound to be reduced, in an acidic medium, ie. at a pH below 7, preferably at from −2 to 5, more preferably at from 0 to 3, in a neutral medium, ie. at a pH of about 7, and in a basic medium, ie. at a pH above 7, preferably at from 9 to 14 and especially at from 12 to 14.

Especially preferably, the reaction is carried out at normal pressure and room temperature.

Within the scope of the process according to the invention the sort of cell type used, the shape and the arrangement of the electrodes do not have any decisive effect, so that it is in principle possible to use any of the cell types customary in electrochemistry.

By way of example the two following apparatus versions may be mentioned:

a) Undivided cells

Undivided cells with a plane-parallel electrode arrangement or candle-type electrodes are preferably used in those cases where neither starting materials nor products are adversely affected by the anode process or react with one another. The electrodes are preferably arranged so as to be plane-parallel, because this embodiment combines a narrow interelectrode gap (from 1 mm to 10 mm, preferably 3 mm) with homogeneous current distribution.

b) Divided cells

Divided cells with a plane-parallel electrode arrangement or candle-type electrodes are preferably used in those cases where the catholyte must be separated from the anolyte, eg. to preclude chemical side reactions or to simplify the subsequent separation of materials. The separating medium used can be in the form of ion exchange membranes, microporous membranes, diaphragms, filter fabrics made of materials which do not conduct electrons, sintered-glass disks and porous ceramics. Preference is given to the use of ion exchange membranes, especially cationic exchange membranes, the use of those membranes being preferred, in turn, which are made of a copolymer from tetrafluoroethylene and a perfluorinated monomer containing sulfo groups. Preferably the electrodes are in a plane-parallel arrangement even in divided cells, since this embodiment combines narrow interelectrode gaps (two gaps from 0 mm to 10 mm each, preferably anodic 0 mm, cathodic 3 mm) with a homogeneous current distribution. Preferably the separating medium lies directly on the anode.

What both apparatus versions have in common is the design of the anode. Suitable electrode materials used, in general, are perforated materials such as nets, metal meshes, lamellae, shaped webs, grids and smooth metal sheets. In the case of the plane-parallel electrode arrangement this is done in the form of planar sheets, in the embodiment comprising candle-type electrodes in the form of a cylindrical arrangement.

The choice of the anode material and of its coating depends on the anolyte solvent. In organic systems graphite electrodes are thus used preferentially, whereas in aqueous systems preference is given to the use of materials or coatings with a low oxygen overpotential. Examples of acidic anolytes to be mentioned in this context are titanium or tantalum supports with electrically conductive interlayers onto which electrically conductive mixed oxides of the IVth to VIth subgroup are applied, which are doped with metals or metal oxides of the platinum group.

With basic anolytes, iron anodes or nickel anodes are used preferentially.

The solvents which can be used in the process according to the invention in principle include all protic solvents, ie. solvents which contain or release protons and/or are able to form hydrogen bonds, such as eg. water, alcohols, amines, carboxylic acids etc., possibly mixed with aprotically polar solvents such as eg. tetrahydrofuran (THF). Because of the ability to maintain the conductivity, preference is given in this context to lower alcohols such as eg. methanol, ethanol, 1-propanol, isopropanol, 1-butanol, sec-butanol or tert-butanol, ethers such as eg. diethyl ether, 1,2-dimethoxyethane, furan, tetrahydrofuran and dimethylformamide. Preference is also given to the use of water, possibly mixed with one or more of the abovementioned alcohols, ether and dimethylformamide (DMF), a mixture of water with methanol, THF or DMF being particularly preferred.

As an alternative to the abovementioned alcohols it is also possible to employ the corresponding acids or amines.

The carboxylic acids used are preferably fatty acids, among which the following may be mentioned: formic acid, acetic acid, propionic acid, butyric acid, valeric acid, caproic acid, enanthic acid, caprylic acid, pelargonic acid, capric acid, undecanoic acid, lauric acid, tridecanoic acid, myristic acid, pentadecanoic acid, palmitic acid, margaric acid, stearic acid, nonadecanoic acid, isobutyric acid, isovaleric acid.

If organic compounds are used which are not soluble in the abovementioned solvents, these may, however, alternatively be brought into solution without difficulty by means of surface-active substances, especially higher alcohols as a solvent or solvent additive, fatty alcohols in particular being worth mentioning. The term fatty alcohols in this context refers to the following alcohols:

1-hexanol, 1-heptanol, 1-octanol, 1-nonanol, 1-decanol, 1-undecanol, 10-undecen-1-ol, 1-dodecanol, 1-tridecanol, 1-tetradecanol, 1-pentadecanol, 1-hexadecanol, 1-heptadecanol, 1-octadecanol.

At the same time, of course, the corresponding alcohols carrying the hydroxyl group on different carbon atoms can likewise be used according to the invention.

If higher alcohols or higher carboxylic acids or higher amines are used it should be borne in mind that the conversion then has to be carried out at relatively high temperatures, so as to maintain the viscosity of the solutions obtained within a range acceptable for carrying out the conversion.

The reduction according to the invention is generally carried out in the presence of a supporting electrolyte. This is added to adjust the conductivity of the electrolysis solution and/or to control the selectivity of the reaction. The electrolyte content as a rule is at a concentration from about 0.1 to about 10, preferably from about 1 to about 5 wt %, in each case based on the reaction mixture. Possible supporting electrolytes include protic acids such as eg. organic acids, among which methanesulfonic acid, benzenesulfonic acid or toluenesulfonic acid may be mentioned, and mineral acids such as eg. sulfuric acid and phosphoric acid. Additionally, the supporting electrolytes used may also be neutral salts. Eligible cations in this context are metal cations of lithium, sodium, potassium, but also tetraalkylammonium cations such as eg. tetramethylammonium, tetraethylammonium, tetrabutylammonium and dibutyldimethylammonium. Anions to be mentioned are: fluoride, tetrafluoroborate, sulfonates such eg. methanesulfonate, benzenesulfonate, toluenesulfonate, sulfates such as eg. sulfate, methyl sulfate, ethyl sulfate, phosphates such as eg. methyl phosphate, ethyl phosphate, dimethyl phosphate, diphenyl phosphate, hexafluorophosphate, phosphonates such as eg. methyl methylphosphonate and methyl phenylphosphonate.

Also suitable for use are basic compounds such as eg. hydroxides, carbonates, hydrogen carbonates and alcoholates of alkali metals or alkaline earth metals, preference among alcoholate anions being given to the use of methylate, ethylate, butylate and isopropylate.

Eligible cations in these basic compounds again include the abovementioned cations.

It follows directly from what has been said above that the process according to the invention can be carried out not only employing a homogeneous solution of the organic compound to be reduced in a suitable solvent, but also in a two-phase system consisting of one phase which contains at least one organic solvent as defined above and the organic compound to be reduced, and a second water-containing phase.

The electrochemical reduction according to the invention can be carried out either continuously or discontinuously. In both reaction modes the cathode is first prepared in situ by a catalytically active layer being formed on the support by alluviation. To this end, perfusion of the support by a suspension of the finely disperse metal and/or the conductive metal oxide and/or the nanocluster and/or the carbonaceous material, ie. the material to be alluviated, is carried out until essentially the entire amount of the material contained in the suspension is held on the support. Whether this is the case can be observed visually, for example by means of the suspension, which is turbid at the beginning of alluviation, becoming clear.

If additionally an interlayer is to be alluviated, the support is perfused by a suspension of the material forming the interlayer, until essentially the entire amount used is held on the support. This is followed by the above-described procedure for alluviating the material which forms the cathodically polarized layer.

If an interlayer is used, there is the additional option of perfusing the support, provided with an interlayer, with a solution or a suspension of a metal salt of a metal with which the support layer is to be doped, and of reducing, by applying a suitable voltage to the cell, the metal cations present in this solution or suspension in situ at the cathode.

After the preparation of the cathode is complete, the organic compound to be reduced is then supplied to the system and is reduced by a previously precisely defined quantity of electricity being introduced into the system. Accurate control of the supplied quantity of electricity makes it possible, within the scope of the process according to the invention, to isolate even partially reduced compounds.

In the case of complete reduction of the organic compounds used as starting materials, the selectivities are at least 70%, generally above 80%, and above 95% for reductions which proceed especially smoothly.

In the course of the product prepared being isolated there is the option of possibly spent catalyst being replaced by means of the flow direction being reversed in the electrolytic cell, as a result of which the alluviated layer loses contact with the support and the catalyst can be removed eg. by removal by suction or filtration of the suspension containing it.

Afterwards the layer can be built up once more as described above, and new starting material can then be supplied and converted.

Furthermore, the steps of conversion (reduction), renewal of the catalyst and renewed conversion (reduction) can also be carried out alternately, the cathode first being prepared in situ by alluviation, as described above, the organic compound to be reduced then being supplied and converted, the flow direction within the electrolytic cell being changed after the conversion is complete and the spent catalyst being removed, eg. by being filtered off, the cathode then again being built up with fresh material forming the cathodic polarized layer and this being followed by continuing reduction.

Of course this alternation between conversion, removal of the spent layer and renewal of the cathode can be repeated any number of times, as a result of which the process according to the invention can be carried out not only discontinously, but also continuously, which leads, in particular, to extremely short down-times during regeneration or when the catalyst is being replaced.

In a further preferred embodiment of the process according to the invention, the electrolysis unit comprising at least one cathode with a shared catholyte circuit is operated in a steady state as a homogeneously continuous reactor. This means that after the catalyst has been alluviated once, a defined concentration level of starting materials and products is maintained. To this end the reaction solution is continuously recirculated by pumping across the electrochemically active cathode and the circuit is continuously supplied with starting material, product being drawn off continuously from this circuit, so that the reactor contents remain constant over time.

The advantage of this process control strategy in comparison with the reaction being operated discontinuously consists in simplified process control involving less complicated equipment.

The conversion-related drawback that it is necessary to put up either with unfavorable concentration conditions (ie. low starting material concentrations and high product concentrations at the end point of the conversion) or more laborious separation during work-up, can be counteracted by means of the following apparatus configuration, which is particularly preferred:

At least two electrolysis units are connected in series, the starting material being supplied to the first unit and the product being drawn from the last unit. This mode of operation ensures that the first electrolysis unit(s) is(are) operated at distinctly more favorable concentration profiles than the last unit(s). This means that, averaged over all the electrolysis units, higher space-time yields are achieved than by managing the reaction so as to operate the electrolysis units in parallel.

This cascade arrangement of the electrolysis units is particularly advantageous in those cases where the demanded production capacity in any case requires the installation of a plurality of electrolysis units.

Organic compounds suitable for use in the process according to the invention in principle comprise any organic compounds containing reducible groups as starting materials. The products which can be obtained in the process include, depending on the total electric charge introduced, both partially reduced compounds and completely reduced compounds. Starting from an alkyne, for example, it is thus possible to obtain both the corresponding alkene and the corresponding, completely hydrogenated or reduced alkane.

Preferably, organic compounds are reduced which have at least one of the following reducible groups or bonds: C—C double bonds, C—C triple bonds, aromatic C—C linkages, carbonyl groups, thiocarbonyl groups, carboxyl groups, ester groups, C—N triple bonds, C—N double bonds, aromatic C—N linkages, nitro groups, nitroso groups, C-halogen single bonds, more preferably an organic compound being reduced which is selected from a group comprising: nitriles, dinitriles, nitro compounds, dinitro compounds, saturated and unsaturated ketones, aminocarboxylic acids.

The process according to the invention makes it possible to reduce, specifically, the following classes of organic compounds in particular.

Organic compounds containing the following structural unit:

$$C{=}C \qquad (I)$$

The above definition includes all organic compounds which contain at least one C—C double bond, such as eg. unsaturated carboxylic acids, aromatic compounds substituted by one or more alkenyl groups, and compounds of the formula (A)

(A)

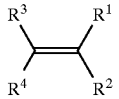

where $R^1$, $R^2$, $R^3$ and $R^4$ are each, independently of one another, hydrogen, alkyl, aryl, aralkyl, alkylaryl, alkoxyalkyl, alkoxy or acyl.

Organic compounds containing the structural unit (II):

$$C{\equiv}C \quad \text{(II)}$$

The above definition comprises all organic compounds which contain at least one C—C triple bond, such as eg. the compounds of the formula (B)

$$R^1{-}{\equiv}{-}R^2 \quad \text{(B)}$$

where $R^1$ and $R^2$ are as defined above.

Organic compounds containing the structural unit (III):

(III)

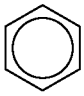

The above definition comprises all organic compounds which contain at least one aromatic ring of the above formula, such as eg. all aromatic monocyclic or polycyclic hydrocarbons and monocyclic substituted aromatic compounds of the formula (C)

(C)

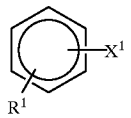

where $R^1$ is as defined above and $X^1$ can be halogen, alkoxy, NR'R", SR' and $P(R')_2$, where R' and R" may be identical or different and are as defined above for $R^1$ to $R^4$.

Organic compounds containing the structural unit (IV)

(IV)

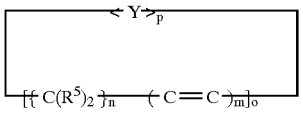

where

Y is NR', $P(R')_3$, oxygen and/or sulfur and R' is as defined above, $R^5$ can be as defined above for $R^1$ to $R^4$ and additionally can be halogen, and n is an integer from 1 to 6, m is an integer from 1 to 4 and o and p are an integer from 1 to 3, the maximum number of the ring atoms being 12.

The above definition comprises all organic compounds containing at least one heterocyclic ring, such as eg. 5-, 6- or higher-membered unsaturated heterocyclic compounds which contain from 1 to 3 nitrogen atoms and/or an oxygen atom or sulfur atom, for example compounds of the formula (D)

(D)

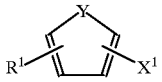

where Y, $X^1$ and $R^1$ are as defined above.

Organic compounds containing the structural unit (V)

(V)

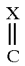

where X can be NR'", oxygen and/or sulfur, where R'" can be alkyl, aryl, alkoxy, hydrogen or hydroxyl.

The above definition comprises all organic compounds containing at least one carbon-heteroatom double bond, such as eg. aldehydes, ketones and the corresponding thio compounds and imines, which can be represented by the following formula (E)

(E)

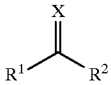

where X, $R^1$ and $R^2$ are as defined above and in addition also aliphatic or aromatic, saturated or unsaturated carboxylic acid derivatives, which then have the structure $R^1COOR^2$, where $R^1$ and $R^2$ are again as defined above.

Organic compounds containing the structural unit (VI):

$$C{\equiv}N \quad \text{(VI)}$$

The above definition comprises all organic compounds which contain at least one C—N triple bond, such as eg. dinitriles and mononitriles, the latter being representable by the following formula (F)

$$R^1{-}C{\equiv}N \quad \text{(F)}$$

where $R^1$ is as defined above.

Organic compounds containing the structural unit (VII):

$$C{-}X^2{-}O_xR^2{}_y \quad \text{(VII)}$$

The above definition comprises all organic compounds containing at least one bond of the above type, ie. any heterocarbonyl analogues of the above type, among which nitro and nitroso compounds may be mentioned in particular, said heterocarbonyl analogues being representable by the formula (G)

$$R^1{-}X^2{-}O_xR^2{}_y \quad \text{(G)}$$

where $R^1$ and $R^2$ are as defined above, $X^2$ is nitrogen, phosphorus or sulfur, X is an integer from 1 to 3 and y is 0 or 1.

Organic compounds containing the structural unit (VIII)

$$C{-}Z \quad \text{(VIII)}$$

where Z is fluorine, chlorine, bromine, iodine and/or alkoxy.

The above definition comprises all organic compounds which contain halogen atoms as defined above or an oxyalkyl group, such as eg. saturated hydrocarbons or aromatic hydrocarbons which are substituted by at least one of the abovementioned groups and can be represented, for example, by the following two formulae (H) and (I)

(H)

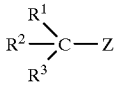

(I)

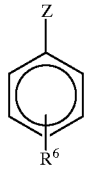

where $R^1$ to $R^3$ and Z are as defined above, and $R^6$ is as defined above for $R^1$ to $R^4$ and additionally can be formate, trifluoroacetate, mesylate and tosylate.

Specifically, the following compounds or classes of compound can be converted:

Unsaturated acyclic hydrocarbons having at least one double and/or triple bond corresponding to the above structures (I) and (II) which can be converted to give the corresponding saturated compounds or, if the starting materials contain more than one C—C double bond and/or at least one C—C triple bond, alternately to give the corresponding compounds which have at least one fewer double bond than the starting materials or instead of a triple bond a double bond.

1. To be mentioned in particular in this context are alkenes having from 2 to 20, preferably from 2 to 10 and especially from 2 to 6 C atoms, such as eg. ethene, propene, 1-butene, 2-butene, isobutene, 1-pentene, 2-pentene, 3-pentene, 2-methyl-1-butene, 3-methyl-1-butene, 2-methyl-2-butene, 1-hexene, 2-hexene, 3-hexene, 1-heptene, 2-heptene, 3-heptene, 1-octene, 2-octene, 3-octene, 4-octene, 1-nonene, 2-nonene, 3-nonene, 4-nonene, 1-decene, 2-decene, 3-decene, 4-decene, 5-decene, 1-undecene, 5-undecene, 1-dodecene, 6-dodecene, 1-tridecene, 1-tetradecene, 1-pentadecene, 1-hexadecene, 1-heptadecene and tetrahydrogeranylacetone.

Alkynes having from 2 to 20, preferably from 2 to 10 and especially from 2 to 6 C atoms, such as for example acetylene, propyne, butyne, pentyne, 3-methyl-1-butyne, hexyne, heptyne, octyne, nonyne, decyne, undecyne, dodecyne, tridecyne, tetradecyne, pentadecyne, hexadecyne, heptadecyne, methylbutynol, dehydrolinalool, hydrodehydrolinalool and 1,4-butynediol.

Polyenes and polyynes having from 4 to 20, preferably from 4 to 10 C atoms, such as, for example, butadiene, butadiyne, 1,3-, 1,4-pentadiene, pentadiyne, 1,3-, 1,4-, 1,5-, 2,4-hexadiene, hexadiyne, 1,3,5-hexatriene, 1,3-, 2,4-, 1,6-heptadiene and 1,3-, 1,7-, 2,4-, 3,5-octadiene.

2. Unsaturated monocyclic hydrocarbons having at least one double and/or triple bond.

To be mentioned among these, in particular, are cycloalkenes having from 5 to 20, preferably from 5 to 10 C atoms, such as, for example, cyclopentene, cyclohexene, cycloheptene, cyclopentadiene, cyclohexadiene, cycloheptatriene, cyclooctatetraene and 4-vinylcyclohexene.

Cycloalkynes having from 6 to 20 C atoms, such as eg. cycloheptyne and cyclooctadiyne;

monocyclic aromatic compounds having from 6 to 12 C atoms, such as, for example, benzene, toluene, 1,2-, 1,3-, 1,4-xylene, 1,2,4-, 1,3,5-, 1,2,3-trimethylbenzene, ethylbenzene, 1-ethyl-3-methylbenzene, cumene, styrene, stilbene and divinylbenzene.

3. Unsaturated polycyclic hydrocarbons having from 8 to 20 C atoms, such as, for example, pentalene, indene, naphthalene, azulene, heptalene, biphenylene, as-indacene, s-indacene, acenaphthylene, fluorene, phenalene, phenanthrene, anthracene, fluoranthene, acephenanthrylene, aceanthrylene, triphenylene, pyrene, chrysene, naphthacene, pleiadene, picene, perylene and pentaphene;

4. Unsaturated polycyclic hydrocarbons having from 8 to 20 C atoms which are linked to one another via single or double bonds, such as, for example, biphenyl, 1,2'-binaphthyl and o- and p-terphenyl.

5. Unsaturated heterocyclic systems containing units in accordance with the above structure (IV) having from 5 to 12 members which contain from 1 to 3 nitrogen atoms and/or oxygen or sulfur atoms and at least one C—C double bond in the ring, which can be converted to give the corresponding heterocyclic compounds which have at least one fewer C—C double bond than the starting material, and if required can be converted to give the corresponding saturated heterocyclic compounds, such as, for example, thiophene, benzo[b]thiophene, dibenzo[b,d]thiophene, thianthrene, pyranes such as eg. 2H-pyrane or 4H-pyrane, furan, 1,4- and 1,3-dihydrofuran, benzofuran and isobenzofuran, 4aH-isochromene, xanthene, 1H-xanthene, phenoxathiine, pyrrole, 2H-pyrrole, imidazole, 4H-imidazole, pyrazole, 4H-pyrazole, pyridine, pyrazine, pyrimidine, pyridazine, indolizine, isoindole, 3aH-isoindole, indole, 3aH-indole, indazole, 5H-indazole, purine, 4H-quinolizine, quinoline, isoquinoline, phthalazine, 1,8-naphthyridine, quinoxaline, quinazoline, cinnoline, pteridine, carbazole, 8aH-carbazole, β-carboline, phenanthridine, acridine, perimidine, 1,7-phenanthroline, phenazine, phenarsazine, phenothiazine, phenoxazine, oxazole, isoxazole, phosphindole, thiazole, isothiazole, furazane, phosphinoline, chromane, isochromane, 2-, 3-pyrroline, 2-, 4-imidazoline, 2-, 3-pyrazoline, indoline, isoindoline, phosphindoline, 1,2,3-, 1,2,4-, 1,3,4-, 1,2,5-oxadiazole, 1,2,3-, 1,2,4-, 1,3,4-, 1,2,5-thiadiazole and 1,2,3-, 1,2,4- and 1,3,5-triazine.

6. Organic compounds having at least one double bond between a carbon atom and an atom other than carbon, which is selected from nitrogen, phosphorus, oxygen and sulfur, as defined above as structure (V), N and P again, as defined above, optionally being substituted themselves, which can be converted to give the corresponding hydrogenated compounds, to be mentioned among which are, in particular, carbonyl compounds having from 2 to 20 C atoms, preferably from 2 to 10 C atoms and especially from 2 to 6 C atoms, such as eg. aliphatic and aromatic aldehydes such as eg. acetaldehyde, propionaldehyde, n-butyraldehyde, valeraldehyde, caproaldehyde, heptaldehyde, phenylacetaldehyde, acrolein, crotonaldehyde, benzaldehyde, o-, m-, p-tolualdehyde, salicylaldehyde, cinnamaldehyde, o-, m-, p-anisaldehyde, nicotinaldehyde, furfural, glyceraldehyde, glycolaldehyde, citral, vanillin, piperonal, glyoxal, malonaldehyde, succinaldehyde, glutaraldehyde, adipaldehyde, phthalaldehyde, isophthalaldehyde and terephthalaldehyde; ketones such as eg. acetone, methyl ethyl ketone, 2-pentanone, 3-pentanone, 2-hexanone, 3-hexanone, methyl isobutyl ketone, cyclohexenone, acetophenone, propiophenone, benzophenone, benzalacetone, dibenzalacetone, benzalacetophenone, 2,3-butanedione, 2,4-pentanedione, 2,5-hexanedione, deoxybenzoin, chalcone, benzil, 2,2'-furil, 2,2'-furoin, acetoin, benzoin, anthrone and phenanthrone;

saturated and unsaturated aliphatic and aromatic mono- and dicarboxylic acids having from 1 to 20, preferably from 2 to 10, more preferably from 2 to 6 carbon atoms, such as, for example, formic acid, acetic acid, propionic acid, butyric acid, caprylic acid, capric acid, lauric acid, myristic acid, palmitic acid, stearic acid, acrylic acid, propiolic acid, methacrylic acid, crotonic acid, isocrotonic acid and oleic acid, cyclohexanecarboxylic acid, benzoic acid, phenylacetic acid, o-, m-, p-toluic acid, o-, p-chlorobenzoic acid, o-, p-nitrobenzoic acid, salicylic acid, phthalic acid, naphthoic acid, cinnamic acid, nicotinic acid, and substituted acyclic and cyclic carboxylic acids such as eg. lactic acid, malic acid, mandelic acid, salicylic acid, anisic acid, vanillic acid, veratroic acid, oxocarboxylic acids such as eg. glyoxylic acid, pyruvic acid, acetoacetic acid, levulinic acid;

α-aminocarboxylic acids, ie. all the α-aminocarboxylic acids such as eg. alanine, arginine, cysteine, proline, tryptophan, tyrosine and glutamine, but also other aminocarboxylic acids such as eg. hippuric acid, anthranilic acid, carbamic acid, carbazic acid, hydantoic acid, aminohexanoic acid, and 3- and 4-aminobenzoic acid;

saturated and unsaturated dicarboxylic acids having from 2 to 20 carbon atoms, such as eg. oxalic acid, malonic acid, succinic acid, glutaric acid, adipic acid, pimelic acid, suberic acid, azelaic acid, sebacic acid, maleic acid, fumaric acid, phthalic acid, isophthalic acid, terephthalic acid and sorbic acid, and esters of the abovementioned carboxylic acids, among which the methyl, ethyl and ethylhexyl esters should be mentioned in particular.

7. Organic compounds containing units in accordance with structure (VI), ie. mono- and dinitriles having from 2 to 20, preferably from 2 to 10, more preferably from 2 to 6 carbon atoms, which can be converted to give the corresponding imines, amines or aminonitriles and diamines respectively. To be mentioned among these in particular are the following nitriles:

acetonitrile, propionitrile, butyronitrile, stearonitrile, acrylonitrile, methacrylonitrile, isocrotononitrile, 3-butenecarbonitrile, propynecarbonitrile, 3-butynecarbonitrile, 2,3-butadienecarbonitrile, glutarodinitrile, maleodinitrile, fumarodinitrile, adipodinitrile, 2-hexene-1,6-dicarbonitrile, 3-hexene-1,6-dicarbonitrile, methanetricarbonitrile, phthalodinitrile, terephthalodinitrile, 1,6-dicyanohexane and 1,8-dicyanooctane.

8. Heterocarbonyl analogues containing at least one unit of the above-defined structure (VII), of which nitro and nitroso compounds should be mentioned in particular, which in each case can be converted to give the corresponding reduced compounds such as eg. amines.

To be mentioned in particular among these are aliphatic or aromatic, saturated or unsaturated, acyclic or cyclic nitro and nitroso compounds having from 1 to 20, preferably from 2 to 10, especially from 2 to 6 carbon atoms such as eg. nitrosomethane, nitrosobenzene, 4-nitrosophenol, 4-nitroso-N,N-dimethylaniline and 1-nitrosonaphthalene, nitromethane, nitroethane, 1-nitropropane, 2-nitropropane, 1-nitrobutane, 2-nitrobutane, 1-nitro-2-methylpropane, 2-nitro-2-methylpropane, nitrobenzene, m-, o- and p-dinitrobenzene, 2,4- and 2,6-dinitrotoluene, o-, m- and p-nitrotoluene, 1- and 2-nitronaphthalene, 1,5- and 1,8-dinitronaphthalene, 1,2-dimethyl-4-nitrobenzene, 1,3-dimethyl-2-nitrobenzene, 2,4-dimethyl-1-nitrobenzene, 1,3-dimethyl-4-nitrobenzene, 1,4-dimethyl-2,3-dinitrobenzene, 1,4-dimethyl-2,5-dinitrobenzene and 2,5-dimethyl-1,3-dinitrobenzene, o-, m- and p-chloronitrobenzene, 1,2-dichloro-4-nitrobenzene, 1,4-dichloro-2-nitrobenzene, 2,4-dichloro-1-nitrobenzene and 1,2-dichloro-3-nitrobenzene, 2-chloro-1,3-dinitrobenzene, 1-chloro-2,4-dinitrobenzene, 2,4,5-trichloro-1-nitrobenzene, 1,2,4-trichloro-3,5-dinitrobenzene, pentachloronitrobenzene, 2-chloro-4-nitrotoluene, 4-chloro-2-nitrotoluene, 2-chloro-6-nitrotoluene, 3-chloro-4-nitrotoluene, 4-chloro-3-nitrotoluene, nitrostyrene, 1-(2'-furyl)-2-nitroethanol and dinitropolyisobutene, o-, m-, p-nitroaniline, 2,4-, 2,6-dinitroaniline, 2-methyl-3-nitroaniline, 2-methyl-4-nitroaniline, 2-methyl-5-nitroaniline, 2-methyl-6-nitroaniline, 3-methyl-4-nitroaniline, 3-methyl-5-nitroaniline, 3-methyl-6-nitroaniline, 4-methyl-2-nitroaniline, 4-methyl-3-nitroaniline, 3-chloro-2-nitroaniline, 4-chloro-2-nitroaniline, 5-chloro-2-nitroaniline, 2-chloro-6-nitroaniline, 2-chloro-3-nitroaniline, 4-chloro-3-nitroaniline, 3-chloro-5-nitroaniline, 2-chloro-5-nitroaniline, 2-chloro-4-nitroaniline, 3-chloro-4-nitroaniline, o-, p- and m-nitrophenol, 5-nitro-o-cresol, 4-nitro-m-cresol, 2-nitro-p-cresol, 3-nitro-p-cresol, 4,6-dinitro-o-cresol and 2,6-dinitro-p-cresol.

9. Halogen-containing aromatic or aliphatic hydrocarbons or compounds which are substituted by an alkoxy group (as defined above as structure VIII and formulae G and H), which can be reduced to the corresponding hydrocarbons.

To be mentioned as starting materials are, in particular, compounds having from 2 to 20 C atoms and from 1 to 6, preferably from 1 to 3 halogen atoms, preferably chlorine, fluorine, bromine or iodine, more preferably chlorine, fluorine, bromine and especially chlorine and bromine, such as eg. bromobenzene and trichloroethylene, but of course also any compound mentioned under items 1. to 7. and substituted by one or more of the abovementioned halogen atoms or an alkoxy group.

10. Additionally, natural and synthetic dyes as described for example in detail in "Ullmanns Enzyklopädie der technischen Chemie", 4th Edition (1976), Volume 11, pp. 99–144, to be mentioned among which in particular are carotenoids such as eg. astaxanthine, carotene, quinone dyes such as eg. dianthronyl, alkannin, carminic acid, 1,8-dihydroxy-3-methylanthraquinone, alizarin dyes such as eg. 1,2-, 1,3- and 1,4-dihydroxyanthraquinone, 1,2,4-trihydroxyanthraquinone, 1,3-dihydroxy-2-methylanthraquinone and 1,2-dihydroxy-1-methoxyanthraquinone, indigoid dyes such as eg. synthetic or natural indigo, indigotin, anile and 6,6'-dibromo indigo, pyrone dyes such as eg. flavone, isoflavone and flavanone.

Especially preferably, the process according to the invention is employed for the following conversions:

1. Conversion of the dinitriles of saturated aliphatic dicarboxylic acids into the corresponding aminonitrile, such as eg. the selective conversion of adipodinitrile into the aminocapronitrile while largely avoiding the complete reduction to hexamethylenediamine.

Particularly suitable for this type of conversions are the following materials forming the cathodically polarized layer:

Raney Ni, Raney Co and Pd/C, the conversion being carried out in a neutral to basic medium (pH from 7 to 14).

2. It is also possible for dinitriles of aromatic carboxylic acids to be converted into the corresponding aminonitriles, such as eg. phthalodinitrile into 2-aminobenzonitrile, the following materials forming the cathodically polarized layer being employed in particular in this case:

Raney Ni, Raney Co, the conversion again being carried out in a neutral to basic medium.

3. Conversion of aliphatic or aromatic carboxylic acid dinitriles into the corresponding diamines, such as eg. the conversion of adipodinitrile into hexamethylenediamine.

This conversion is preferably carried out with those materials forming the cathodically polarized layer as defined under 1. (dinitriles of aliphatic carboxylic acids) or those materials forming the cathodically polarized layer as defined under 2. (dinitriles of aromatic carboxylic acids), the conversion being carried out in each case under the conditions specified in 1. and 2., respectively.

4. Conversion of imino-isophorononitrile into isophoronediamine

The same materials forming the cathodically polarized layer and the same conditions are employed here as defined under 1.

5. Conversion of aromatic dinitro compounds into the corresponding diamino compounds, such as eg. the conversion of dinitrotoluene to diaminotoluene For this purpose preference is given to the use of the following materials forming the cathodically polarized layer:

Raney Ni and Pd/C, the conversion being carried out in an approximately neutral medium (pH from 5 to 7).

6. Conversion of aromatic aminocarboxylic acids into the corresponding aminohydroxy derivatives, such as eg. the conversion of 2-aminobenzoic acid to 2-aminobenzyl alcohol, this type of conversion employing, in particular, the following materials forming the cathodically polarized layer:

Cu catalysts such as eg. Cu/C, the conversion being carried out in an acidic medium (pH from 0 to 7).

7. Conversion of natural and synthetic dyes into compounds which are hydrogenated on one or more C—C double bonds, such as eg. the conversion of indigo into leucoindigo and 1,4-dihydroxyanthraquinone into 1,4-dihydroxy-2,3-dihydroanthraquinone, the following materials forming the cathodically polarized layer being employed in particular:

Pd/C, Pt/C, Rh/C and Ru/C, the conversion being carried out in an acidic medium.

EXAMPLES

Example 1

Within a divided cell having an anode area and cathode area of 100 $cm^2$ each, a filter plate was installed which was covered with a 50 $\mu$m warp twill fabric of alloy steel material No. 1.4571 as the cathode. Via a separate filtrate line the filtrate can be discharged from a cavity underneath the filter fabric.

The anode employed was a titanium anode, designed to liberate oxygen and coated with Ta/Ir mixed oxide. The separating medium used was a NAFION-324 cation exchange membrane (commercially available from Du Pont). The divided cell was incorporated into a twin-circuit electrolytic apparatus equipped with pump circuits.

The conversion was carried out discontinuously in the following sequence:

1100 g of 5% strength aqueous sulfuric acid were used as the anolyte.

The catholyte was prepared by 5 g of vinclozoline [(RS)-3-(3,5-dichlorophenyl)-5-methyl-5-vinyl-oxazoline-2,4-dione] being dissolved in a mixture of 500 g of water, 375 g of methanol, 375 g of isobutanol and 65 g of acetic acid. The cathode circuit was charged with 1200 g of the catholyte batch.

According to a titrimetric assay, the catholyte batch prior to the reaction is chloride-free.

While the filtrate outlet was closed, 15 g of graphite powder were added into the circulating catholyte circuit and were dispersed in the circulation. Alluviation was effected by the catholyte circulation being shut and the filtrate outlet being opened. The pressure in the cathode compartment rose to $4\times10^5$ Pa, and the filtrate throughput was 12 l/h. This was followed by 5 g of catalyst (Degussa Type E101N/D, 10% Pd on carbon) being additionally alluviated in the same manner. Over a period of 30 min, a DC current of 20 A was then imposed which required a cell voltage of 35 V at the outset and as much as 7.5 V at the end of the experiment.

According to a titrimetric assay, 850 ppm of chloride were detected in the output from the reaction, corresponding to a conversion ratio of 90%.

Analysis of the obtained product by means of gas chromatography confirmed the following conversion:

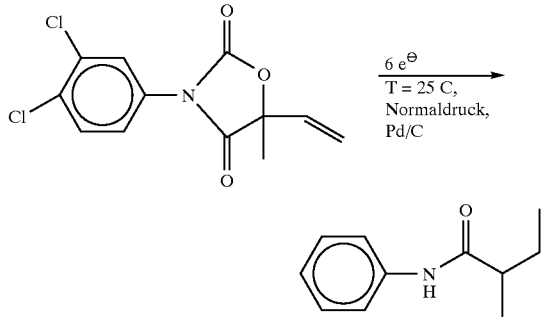

Example 2

The following example, which relates to the reduction of adipodinitrile (ADN) to hexamethylenediamine (HDA), and the subsequent examples were carried out in the following apparatus.

Electrolytic cell: divided electrolytic cell of the flow-cell type

Membrane: NAFION-324

Anode: DeNora dimensionally stable anode (DSA) (anode area: 100 $cm^2$)

Cathode: Armor chain of alloy steel material No. 1.4571 (cathode area: 100 $cm^2$, pore size: 50 $\mu m$)

Throughput: about 20 l/h through the cathode.

1200 g of 2% strength sulfuric acid were used as the anolyte.

The catholyte consisted of a mixture of 693 g of methanol, 330 g of $H_2O$, 22 g of NaOH, 55 g of adipodinitrile (0.509 mol) and 7.5 g of Raney nickel (BASF $H_1$-50).

The conversion was carried out as follows:

First the two cell compartments were charged, and then the Raney nickel was washed against the cathode over a period of 10 min.

Then the electrolysis was carried out at between 30 and 40° C. with a current density of 1000 $A/m^2$ at normal pressure. The electrolysis was stopped after 8.5 F/mol of ADN. After the NaOH had been separated off by means of electrolysis the product was isolated by distillation. 56 g (95% based on the amount of ADN used) of hexamethylenediamine were obtained.

Example 3

The identical reaction apparatus, the identical anolyte and the identical catholyte as in Example 2 being employed, adipodinitrile was converted into 6-aminocapronitrile (ACN), the preparation of the cathode and the electrolysis being carried out in the same way as in Example 2, except that the electrolysis was terminated after only 4 F/mol of ADN. After the NaOH had been separated, followed by distillation, 38.7 g (0.34 mol, 68% of ADN) of aminocapronitrile, 16% of hexamethylenediamine and 14% of ADN were isolated. The selectivities were 79% for aminocapronitrile and 18.6% for hexamethylenediamine.

Example 4

The next conversion was carried out employing the identical apparatus and the identical anolyte as in Example 2. The catholyte employed was a mixture of 110 g (0.92 mol) of acetophenone, 638 g of methanol, 330 g of water, 22 g of NaOH and 7.5 g of Raney nickel.

The preparation of the cathode and the conversion were carried out in the same way as in Example 2, except that the electrolysis was terminated after only 2.3 F/mol of acetophenone.

After dilution with water (1 l) the product was isolated by extraction with 5×200 ml of MTBE (t-butyl methyl ether), evaporation and distillation, and 101.3 g (yield: 90%, based on acetophenone) of 1-phenylethanol were obtained.

Example 5

The reduction of 2-cyclohexanone to cyclohexanol was carried out employing the same apparatus and the same anolyte as in Example 2. The catholyte used was a mixture of 737 g of methanol, 330 g of water, 11 g of NaOH, 22 g of 2-cyclohexanone and 7.5 g of Raney nickel. The conversion was carried out as in Example 2, except that the electrolysis was terminated after 6 F/mol of 2-cyclohexanone. The output obtained was concentrated by distillation to 270 g, diluted with 500 ml of water and extracted with 5×200 ml of MTBE. The organic phase was then distilled, and 21.7 g of cyclohexanol were obtained, which corresponds to a yield of 95% based on 2-cyclohexanone.

Example 6

This example was carried out in the same apparatus as in Example 2. 1100 g of 1% strength sulfuric acid were used as the anolyte. The catholyte consisted of a mixture of 418 g of methanol, 318 g of distilled water, 297 g of sodium methyl sulfate solution, 7.4% strength in methanol, 55 g of cyclohexanone oxime (0.487 mol) and 8 g of copper powder.

The conversion was carried out as follows:

First the cell compartments were charged, and then the copper powder was washed against the above cathode over a period of 10 min. Then the electrolysis was carried out at a temperature of between 30 and 50° C. with a current density of 1000 $A/m^2$ at normal pressure. An electrical charge of 12 F/mol was applied, based on the oxime used.

To work up the product, the catholyte was set to a pH of 13 with sodium hydroxide solution, the copper powder was filtered off, the filtrate was concentrated to 639 g and extracted 5 times with 100 g of MTBE each. After drying and removal of the solvent the crude product was distilled. 35.2 g of cyclohexylamine (73%, based on the oxime used) could be isolated as the reaction product.

Example 7

This example was carried out in the same apparatus as in Example 2. 1100 g of 1% strength sulfuric acid were used as the anolyte. The catholyte consisted of a mixture of 418 g of methanol, 330 g of distilled water, 297 g of sodium methyl sulfate solution, 7.4% strength in methanol, 55 g of 2-butyne-1,4-diol (0.64 mol) and 15 g of Raney nickel (BASF H1-50).

The conversion was carried out in a manner similar to Example 6:

An electrical charge of 4.5 F/mol was applied, based on the diol used.

To work up the product, the catholyte was filtered, most of the filtrate was evaporated, and the crude product was distilled. 23 g of butanediol-1,4 and 12.4 g of 2-butene-1,4-diol could be isolated as the reaction product.

Example 8

This example was carried out in the same apparatus as in Example 2. 1100 g of 1% strength sulfuric acid were used as the anolyte. The catholyte consisted of a mixture of 704 g of methanol, 330 g of distilled water, 11 g of sulfuric acid, 55 g of nitrobenzene (0.447 mol) and 8 g of copper powder.

The conversion was carried out in a manner similar to Example 6:

An electrical charge of 6.45 F/mol was applied, based on the substrate.

To work up the product, the catholyte was set to a pH of 13 with sodium hydroxide solution, the copper powder was filtered off, the filtrate was concentrated to 597 g and extracted 5 times with 100 g of MTBE each. After drying and removal of the solvent the crude product was distilled. 26.2 g of aniline could be isolated as the reaction product.

Example 9

This example was carried out in the same apparatus as in Example 2, being modified in that an edge filter (pore size 100 $\mu m$) made of alloy steel was employed as the cathode. 1100 g of 1% strength sulfuric acid were used as the anolyte.

The catholyte consisted of a mixture of 806 g of methanol, 377 g of distilled water, 52 g of sodium hydroxide solution, 48 g of 2-thienylacetonitrile (0.391 mol) and 30 g of Raney nickel (BASF H1-50).

The conversion was carried out at 21° C. and a current density of 1000 A/m$^2$. The starting material was added in 14 batches. An electrical charge of 6.45 F/mol was applied, based on the substrate.

To work up the product, the nickel powder was filtered off, the catholyte was neutralized with sulfuric acid and the methanol removed by distillation. After the pH had been set to 13, extraction with MTBE was carried out. After drying and removal of the solvent the crude product was distilled. 37 g of thienylethylamine could be isolated as the reaction product.

Example 10

This example was carried out in the same apparatus as in Example 2, being modified in that an edge filter (pore size 100 $\mu$m) made of platinized titanium was employed as the cathode. 1200 g of 1% strength sulfuric acid were used as the anolyte. The catholyte consisted of a mixture of 651 g of ethylene glycol dimethyl ether, 651 g of distilled water, 28 g of sodium hydroxide solution, 70 g of 2-thienylacetonitrile (0.569 mol) and 50 g of Raney nickel (BASF H1-50).

The conversion was carried out at 23° C. and a current density of 1000 A/m$^2$. An electrical charge of 5.5 F/mol was applied, based on the substrate.

To work up the product, the nickel powder was filtered off, and the filtrate was admixed with 4% of sodium hydroxide and saturated with NaCl. Separation of the phases was followed by distillation. 45 g of thienylethylamine could be isolated as the reaction product.

Example 11

This example was carried out in the same apparatus as in Example 2, being modified in that an edge filter (pore size 100 $\mu$m) made of platinized titanium was employed as the cathode. 1200 g of 1% strength sulfuric acid were used as the anolyte. The catholyte consisted of a mixture of 882 g of methanol, 420 g of distilled water, 28 g of sodium hydroxide solution, 70 g of veratryl cyanide (0.395 mol) and 50 g of Raney nickel (BASF H1-50).

The conversion was carried out at 21° C. and a current density of 1000 A/m$^2$. An electrical charge of 4 F/mol was applied, based on the substrate.

To work up the product, the nickel powder was filtered off, the methanol removed from the filtrate by distillation and the remaining aqueous crude solution extracted 5 times with 100 g of MTBE each. After drying and removal of the solvent the crude product was distilled. 54.5 g of homoveratrylamine could be isolated as the reaction product.

We claim:

1. A process comprising contacting a cathode with an organic compound, wherein the cathode comprises a support made of an electrically conductive material and an electrically conductive, cathodically polarized layer formed thereon in situ by alluviation such that said cathode is stabilized by the pressure drop at said layer formed by alluviation, and electrochemically reducing the organic compound.

2. The process as claimed in claim 1, wherein the cathodically polarized layer contains a metal, a conductive metal oxide or a carbonaceous material or mixtures of two or more thereof.

3. The process as claimed in claim 1, wherein the cathodically polarized layer contains a metal, or a conductive metal oxide thereof, or a mixture of two or more of said metal or conductive metal oxides thereof, said metal being of the Ist, IInd or VIIIth subgroup of the Periodic Table of the Elements.

4. The process as claimed in claim 1, wherein the cathodically polarized layer contains a metal or a conductive metal oxide or a mixture of two or more metals or conductive oxides, applied to activated carbon in each case.

5. The process as claimed in claim 1, wherein the cathodically polarized layer contains Raney nickel, Raney cobalt, Raney silver or Raney iron.

6. The process as claimed in claim 1, wherein the support made of electrically conductive material has pores.

7. The process as claimed in claim 1, wherein the organic compound reduced has at least one of the following reducible groups or bonds: C—C double bonds, C—C triple bonds, aromatic C—C linkages, carbonyl groups, thiocarbonyl groups, carboxyl groups, ester groups, C—N triple bonds, C—N double bonds, aromatic C—N linkages, nitro groups, nitroso groups, C-halogen single bonds.

8. The process as claimed in claim 1, wherein the organic compound reduced is selected from the group comprising: nitriles, dinitriles, nitro compounds, dinitro compounds, saturated and unsaturated ketones, and aminocarboxylic acids.

* * * * *